US012016445B2

(12) United States Patent
Amar

(10) Patent No.: US 12,016,445 B2
(45) Date of Patent: Jun. 25, 2024

(54) NAIL GROOMING DEVICE

(71) Applicant: Tal Amar, Herzelia (IL)

(72) Inventor: Tal Amar, Herzelia (IL)

( * ) Notice: Subject to any disclaimer, the term of this patent is extended or adjusted under 35 U.S.C. 154(b) by 993 days.

(21) Appl. No.: 16/645,659

(22) PCT Filed: Sep. 12, 2018

(86) PCT No.: PCT/IL2018/051022
§ 371 (c)(1),
(2) Date: Mar. 9, 2020

(87) PCT Pub. No.: WO2019/053716
PCT Pub. Date: Mar. 21, 2019

(65) Prior Publication Data

US 2020/0275756 A1 Sep. 3, 2020

Related U.S. Application Data

(60) Provisional application No. 62/557,218, filed on Sep. 12, 2017.

(51) Int. Cl.
*A45D 29/05* (2006.01)
*A45D 29/06* (2006.01)
(Continued)

(52) U.S. Cl.
CPC ..... *A45D 29/05* (2013.01); *A45D 29/06* (2013.01); *A45D 29/14* (2013.01); *A45D 29/17* (2013.01)

(58) Field of Classification Search
CPC ..... A45D 29/02; A45D 29/05; A45D 29/06; A45D 29/11; A45D 29/14
See application file for complete search history.

(56) References Cited

U.S. PATENT DOCUMENTS 7,428,881 B2 9/2008 Drelinger
2011/0226270 A1* 9/2011 Rivera ..... A45D 29/05 132/73.6
(Continued)

FOREIGN PATENT DOCUMENTS

CN 106805449 A 6/2017
DE 3151588 * 12/1981
(Continued)

OTHER PUBLICATIONS

Translation of Thouvenin (Year: 1973).*
(Continued)

*Primary Examiner* — Rachel R Steitz
*Assistant Examiner* — Brianne E Kalach
(74) *Attorney, Agent, or Firm* — Roach Brown Mccarthy & Gruber, P.C.; Kevin D. McCarthy

(57) ABSTRACT

The present invention relates to the field of nail grooming and generally describes a novel nail-grooming device whose purpose is to allow a user to groom his or her own fingernails in both hands in an accurate, symmetrical and uniform manner, with minimal effort and without being required to acquire any skills that might be required by other devices. The device comprises a finger placement wherein a user places his or her finger, and a nail grooming machine with a nail grooming head suitable for nail grooming tasks such as filing, wherein the nail grooming head is capable of performing a cyclic movement against a nail of the finger placed on the finger placement for filing or other nail-grooming task, and wherein the nail filing machine also comprises a mechanism capable of triggering a sideways movement of the nail grooming head on a curved horizontal axis around the nail to allow circumferential grooming of the fingernail while the finger is statically placed on the finger placement.

23 Claims, 16 Drawing Sheets

(51) Int. Cl.
*A45D 29/14* (2006.01)
*A45D 29/17* (2006.01)

(56) References Cited

U.S. PATENT DOCUMENTS

2015/0335131 A1* 11/2015 Ortiz ..... G06F 3/0412
132/73.6
2016/0029768 A1 2/2016 Dai

FOREIGN PATENT DOCUMENTS

DE 4414780 * 10/1995
DE 10157125 C1 * 12/2002 ..... A45D 29/05
FR 2163209 * 6/1973
GB 1133534 A 11/1968

OTHER PUBLICATIONS

Translation of Nermerich (Year: 1995).*
Machine Translation (Year: 2001).*
Written Opinion of the International Searching Authority for PCT/IL2018/051022, dated Dec. 13, 2018; 6 pages.
International Search Report for PCT/IL2018/051022, dated Dec. 13, 2018; 5 pages.

* cited by examiner

NAIL GROOMING DEVICE

FIELD OF THE INVENTION

The present invention relates generally to the field of nail grooming.

BACKGROUND OF THE INVENTION

Nail-care is important for most people, men and women alike. Considering fingernails grow at an average pace of 3.5 mm per month, regular maintenance of fingernails is needed for various considerations, such as health, hygiene, convenience and aesthetics. Improper maintenance of nails may result in injuries to a person that comes into contact with such nails, accumulation of germs under the nails, and even infections which may further jeopardize the health of a person that ingests food touched by such nails. Besides health and hygiene risks, regular nail care is required to allow practical and convenient use of hands and fingers, as improperly maintained nails might interrupt a variety of daily tasks and operations performed by hand. Moreover, proper nail care is also important for aesthetical considerations, as many people consider properly maintained fingernails to indicate positive characteristics of a person, and properly maintained fingernails are considered by many people as aesthetically appealing.

For the abovementioned reasons, most people regularly use a variety of nail care devices, such as nail trimmers, nail groomers and nail files, and likewise many people regularly attend a nail salon to have their nails groomed.

The problem with extant nail care devices, including devices that utilize a motor to automate repetitive motions, is that these devices require the user to tilt the device's head manually through a range of angles around each nail's edges in order to conform to or shape the nail's outline. Due to the instability of a free hand movement and the imprecision of evaluation by eye, this manual operation makes it very difficult to shape the nail's outline in an accurate and symmetrical manner. A uniform nail shape across all fingernails is almost impossible to achieve.

This problem is aggravated when a user is required to perform this operation using her non-dominant hand. As the fine motor skills of the non-dominant hand are inferior in most people, the use of the non-dominant hand to operate a device to groom the fingernails of the dominant hand usually result in a very asymmetrical, rough and uneven shape of the fingernails, and might even cause injuries around the fingernails.

For these reasons, many people prefer to visit a nail salon and have their fingernails groomed by a professional. The problem is that visiting a nail salon regularly is costly, and in any case, a professional at a nail salon still uses the same aforementioned nail grooming devices and therefore, even in such case, a symmetrical shape of each nail and a uniform nail shape across all fingernails will be very hard to achieve.

SUMMARY OF THE INVENTION

The present invention relates to the field of nail grooming. The preferred embodiment of the invention is a nail-grooming device whose purpose is to allow a user to groom his or her own fingernails in both hands in an accurate, symmetrical and uniform manner, with minimal effort and without being required to acquire any nail-grooming skills that might be required by other devices for nail-grooming known from prior art.

While the functioning of the device can be used for various applications related to nail-grooming, such as nail filing, nail trimming, nail cleaning and nail polishing, the following summary and description shall refer to the function of nail filing. However, the present invention should not be inferred as being limited to apply exclusively to nail filing, and should be considered to cover all and to apply on all possible nail-grooming applications mutatis mutandis, as will be demonstrated in the detailed description below.

The device's purpose is achieved by a novel and unobvious combination of elements comprising a finger placement unit, a nail filing machine and a control unit. The nail filing machine comprises a nail filing head positioned in proximity to a nail of a finger placed on the finger placement unit. The nail filing head is covered with an abrasive or rugged surface suitable for filing a nail. The nail filing machine further comprises a mechanism capable of triggering a continuous cyclic movement of the nail filing head to allow filing of a fingernail placed on the finger placement. The nail filing machine also comprises also a mechanism capable of triggering a two-directional back-and-forth sideways movement of the nail filing head on a curved horizontal axis around the nail of a finger placed on the finger placement to allow circumferential filing of the fingernail while the finger is statically placed on the finger placement.

Both cyclic movement axis and sideways movement axis are fixed and cannot be manually altered during the device's operation, thus a predetermined filing pattern is used, resulting in a precise nail outline across all fingernails.

A control unit is installed on the interface of the nail grooming device, mechanically, electronically or electromechanically connected to the nail filing machine to operate and control the nail filing machine. Either the cyclic movement of the nail filing head, the sideways movement of the nail filing head, or both, can be propelled either electromechanically using a power source, manually, or in any other form known from prior art.

The most notable advantage of the present invention, is that while all devices for nail-grooming in the prior art, including those that utilize a motor to propel the nail filing head, require the user to manually tilt the nail filing head in different angles around each of the fingernails, the device of the present invention does not require the user to change position of finger or position of the device throughout the process of filing a nail, and as a result, an accurate and symmetrical shape of nail can be achieved uniformly across all fingernails. This is achieved by an automatic movement of the filing head across a range of positions adapted to conform to the shape of the average fingernail.

In another embodiment of the present invention the nail grooming device comprises an adapter suitable for fixing a mold around the finger placement unit. The adapter may be configured as a groove around or under the finger placement suitable for attachment of a mold with a tongue matching to this groove, or vice versa. The adapter and adaptable part of the mold may also be configured as a socket and a plug, a magnetic material and a ferromagnetic material, or any other attachment method known from the prior art.

In another embodiment of the present invention based on previous embodiment, a set of molds adaptable to the adapter on the nail grooming device is provided with the nail grooming device or available for purchase in addition to the nail grooming device. The structure of the mold may be a thin barrier mounted vertically in proximity to the finger placement, perpendicular to a finger resting on the finger placement, in a position separating between the finger resting on the finger placement and the nail filing head of the nail filing machine. The mold may have a narrow horizontal aperture allowing a nail on a finger resting on the finger placement to cross through the mold into the internal chamber of the nail grooming device, placing the part of nail crossing the aperture in the mold in direct contact with the nail filing head. Each mold is configured to have a different shape corresponding to a different outline of a nail, such that when a mold in a particular shape is installed on the adapter and a nail of a finger resting on the finger placement is crossing through the aperture in the mold, the nail filing head is pressed onto the edges of the nail while operating and circumferentially filing the nail, until the outline of the nail is aligned with the shape of the mold.

Alternatively, the mold can be formed as an elevated surface that restricts the reach of the nail file, having the shape of the desired nail outline. The elevated surface mounted on the distal end of the finger placement, allowing the nail of a finger placed on the finger placement to rest on the elevated surface in a position wherein the edge of the nail is situated in proximity with the nail filing head.

In yet another embodiment of the present invention, the nail filing machine and the finger placement comprising, respectively and interchangeably, a magnetic part and ferromagnetic part, such that said nail filing head is attracted towards the finger placement through magnetic force. The ferromagnetic part may be formed from any ferromagnetic material, such as iron, nickel or cobalt. Alternatively, both parts can be magnetic, insofar their polarity is causing them to be attracted to one another. By having the nail filing head attracted to the finger placement, the nail filing head is constantly pressed onto the outline of a nail of a finger resting on the finger placement, thereby forcing a continuous contact between the nail and nail filing head during the operation of the nail grooming device.

In another embodiment of the present invention, in which the nail grooming device comprises the aforementioned adapter and adaptable molds, the nail filing machine and each of the molds comprising, respectively and interchangeably, a magnetic or ferromagnetic part, such that the nail filing machine is attracted towards each of said set of adaptable molds. Alternatively, the molds may be fully formed from magnetic or ferromagnetic materials.

In yet another embodiment of the present invention, the nail filing machine comprises a spring configured to the nail filing head towards said finger placement. By pushing the nail filing head towards the finger placement unit, the nail filing head is constantly pressed onto the outline of a nail of a finger resting on the finger placement, thereby forcing a continuous contact between the nail and nail filing head during the operation of the nail grooming device.

In another embodiment of the present invention, the nail grooming device is operated by an electromechanical motor. The electromechanical motor can be powered by batteries or any external power source known from the prior art. The motor can propel either the cyclic movement, sideways movement, or ideally, both. The control unit on the nail grooming device is electronically connected to the electromechanical motor, and may contain one controller for triggering both cyclic and sideways movement of the nail filing machine, or separate controllers for triggering each of cyclic and sideways movement of the nail filing machine.

In another embodiment of the present invention, the nail grooming device is operated manually by a mechanism. The mechanism can be propelled by a crank or revolving handle to manually generate rotational motion, which in turn, is converted into reciprocating motion driving the sideways movement of the nail filing head, cyclic movement of the nail filing head, or both. Alternatively, the mechanical mechanism can be propelled by any suitable mechanism used for utilizing manually formed motion for driving continuous mechanical motion.

In another embodiment of the present invention, the finger placement is detachable from said nail grooming device and replaceable. Detachability and replaceability of the finger placement can be used for cleaning the finger placement after use and replacing the finger placement if damaged or worn out. Finger placement can be formed in various shapes and sizes to fit different fingers and different hand sizes, to allow a user to attach to the nail grooming device a finger placement that fits the size of fingers undergoing nail filing. The finger placement may be attachable to the nail grooming device in any form known from the prior art.

In yet another embodiment of the present invention, the nail grooming device comprising a mechanism for adjustment of width of the finger placement. Thus, the width of the finger placement can be adjusted to fit exactly the width of a finger placed on the finger placement. The width of the finger placement can be adjusted using any gripping or fastening mechanism know from the prior art.

In another embodiment of the present invention, the nail filing machine comprises an adapter for mounting a removable nail filing head. The adapter is formed on the proximal end of the arm connecting between the nail filing head and the mechanism or motor propelling the nail filing head. The arm itself is configured to sway sideways to drive the sideways movement of the nail filing head. The adapter is used both for attachment of a nail filing head and transmission of mechanical motion for driving the cyclic movement of the nail filing head, or transfer electronic current to the nail filing head, if the electromechanical mechanism generating the cyclic movement is incorporated within the nail filing head.

In another embodiment of the present invention based on the previous embodiment, the nail grooming device comprises a set of removable nail filing heads adaptable to said adapter on said nail filing machine. The different nail filing heads can be configured in a variety of shapes, sizes, textures, angles and surface profiles, to fit to specific purposes. A different pattern of cyclic movement of the nail filing head might be required for different nail filing heads. Therefore, each nail filing head may incorporate a frame or other passive component configured to receive mechanical motion transmitted through the adapter and to mechanically transform such motion to a specific pattern of cyclic movement of nail filing head. Alternatively, the nail filing head may incorporate an active component receiving electric current through the adapter to generate cyclic movement in a specific pattern.

In a more advanced embodiment of the present invention, the nail grooming device further comprising interchangeable patterns of cyclic movement that affect the type of filing strokes, allowing the user to select a particular pattern to achieve a specific result. Possible patterns of the cyclic movement may include straight up-and-down, curved up-and-down, short range up-and-down, long range up-and-down, circular, left-and-right or diagonal patterns. The patterns can be formed by interchanging frames installed within nail filing machine, each of the frames forcing and restricting the movement of the nail filing head to a particular pattern, or in any other way known from the prior art. The control unit may include a selector or any other type of controller or set of controllers for switching between the different patterns of cyclic movement, sideways movement, or both, allowing a user to select a specific pattern to achieve a particular result. Alternatively, a user may manually replace frames on the nail filing machine to switch between different patterns of movement. Another embodiment of the present invention comprising interchangeable patterns of sideways movement.

In another embodiment of the present invention the speed of the cyclic movement is adjustable by a controller on the control unit, electronically connected to the motor of the nail filing machine to allow a user to increase or decrease the speed of the cyclic movement of the nail filing head. In another embodiment of the present invention the speed of the sideways movement is similarly adjustable.

In another embodiment of the present invention, the nail grooming device comprises a nail polish head installable on the proximal end nail filing machine to perform nail polishing of a finger placed on the finger placement unit. The nail polish head comprising a nail polish brush and a container fillable with liquid nail polish, while the nail polish brush is in flow communication with the container via a tube during the operation of the nail grooming device, continuously loading the nail polish brush with liquid nail polish.

In another embodiment of the present invention, the nail grooming device comprising a nail trimming head installable on said nail filing machine. The nail trimming head may be formed by two or more blades configured to move towards and away from nail for trimming of a nail.

In another embodiment of the present invention, the nail grooming device comprising a nail filing wheel head installable on the nail filing machine and covered with an abrasive or rugged surface suitable for filing a nail. The nail filing wheel may be mounted horizontally or vertically facing a nail of a finger placed on the finger placement unit, and configured to rotate for filing said nail.

In another embodiment of the present invention, the nail grooming device comprising a nail cleaning head installable on said nail filing machine and covered with a soft absorbing surface, such as various types of fabrics. The nail cleaning head may be configured as a wheel mounted horizontally or vertically facing a nail of a finger placed on the finger placement unit, and configured to rotate for cleaning said nail.

In a more advanced embodiment of the present invention, the nail grooming device comprising multiple sets of the nail filing machine and the finger placement unit for simultaneous filing of multiple nails. Possible embodiments may comprise two or more sets of nail filing machine and finger placement unit for processing of two or more nails simultaneously, and up to five sets of nail filing machine and finger placement unit, for processing of all nails of all fingers in a hand simultaneously. Such embodiments should be interpreted to allow all types of heads, such as nail filing heads, nail polish heads and nail cleaning heads.

In yet another embodiment of the present invention, the nail grooming device is designed to accommodate toes on a foot and to file nails of toes on a foot. The mechanism of nail filing machine is generally similar to the mechanism of the nail filing machine fitted for fingernails, configured to perform cyclic movement and sideways movement of nail filing head, with finger placement unit scaled to accommodate toes of a foot and mold designed to restrict movement of nail filing head around the outline of nail of a toe. This embodiment should be interpreted to allow all types of heads, such as nail filing heads, nail polish heads and nail cleaning heads.

In another embodiment of the present invention, the nail grooming device is controllable via a computer application. The computer application may be installed on a mobile device, such as a smartphone or tablet computer, or on a desktop or laptop computer, and communicate with the nail grooming device either through a physical connection or through a wireless technology such as Bluetooth, Wi-Fi or any other wireless technology known from the prior art. The nail grooming device may comprise a camera directed to a nail of a finger resting on finger placement unit to monitor real-time progress of nail filing, while such data is transferred to the computer application in real-time. The computer application may collect, store and process data from the grooming device, such as dates of use, which fingers were processed, length of nail reduced or types of molds used. The computer application may also control various features controllable through control unit of nail grooming device, such as activation and deactivation, pattern and speed of cyclic movement and sideways movement.

BRIEF DESCRIPTION OF THE DRAWINGS

Embodiments and features of the present invention are described herein in conjunction with the following drawings:

FIG. 1*a*, FIG. 1*b* and FIG. 1*c* depict a nail-grooming device; FIG. 1*a* depicts an external view thereof and FIG. 1*b* depicts an internal view thereof.

DETAILED DESCRIPTION OF PREFERRED EMBODIMENTS

The present invention will be understood from the following detailed description of preferred embodiments, which are meant to be descriptive and not limiting. For the sake of brevity, some well-known features, methods, systems, procedures, components, and so on, are not described in detail.

Figure 1A:
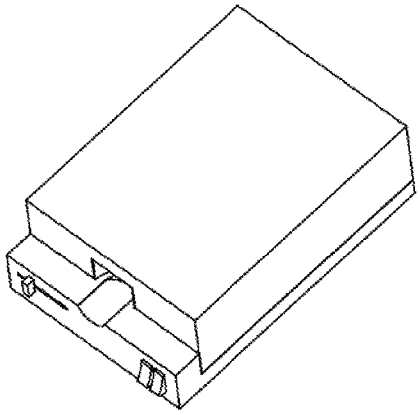
Figure 1B:
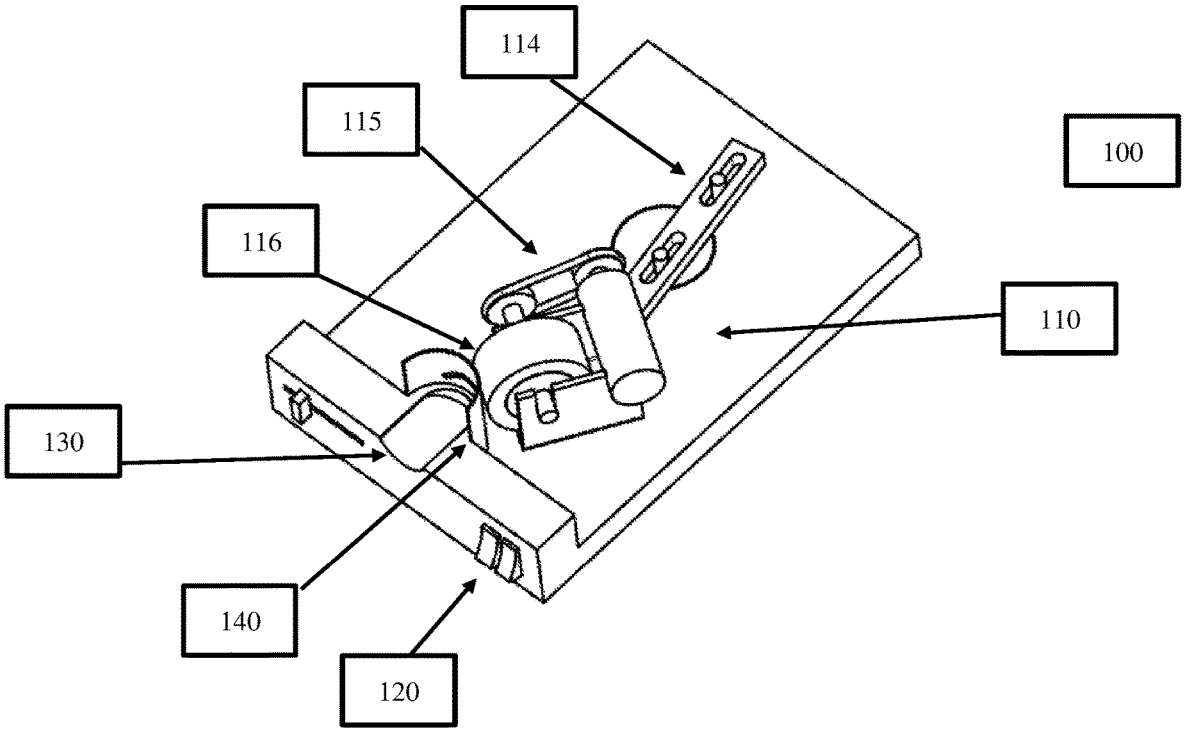

FIG. 1*a* and FIG. 1*b* depict one embodiment of the present invention, wherein a nail grooming device comprising a finger placement unit and a nail file; said nail file is capable of cyclic movement to allow filing of a nail; furthermore, said nail file is also capable of movement sideways around a nail on a curved horizontal axis to allow circumferential filing of a nail while a finger is statically placed on said finger placement unit; the nail grooming device can be operated by a user for circumferential filing of a nail of a finger placed on said finger placement unit without changing the position of the nail grooming device.

The illustration in FIG. 1*a* depicts the nail-grooming device with its casing covering the filing head and mechanism operating the cyclic movement and sideways movement, to protect said mechanism and to provide a comfortable and aesthetic design of the device for a user, whereas the finger placement unit is not covered by the casing to allow comfortable access for a user to place his finger. The illustrations in FIG. 1*b* depicts the nail-grooming device shown in FIG. 1*a* without a casing covering the said filing head and mechanism. These illustrations display one embodiment of the nail grooming device and mechanisms operating the cyclic movement and sideways movement.

In the current embodiment, the nail grooming device (100) is operated electro-mechanically, utilizing a motor powered by a power source to move both the cyclic movement and sideways movement of the nail filing machine (110). Accordingly, the control unit (120) of the device comprising two switches, one intended to turn on and off the cyclic movement of the filing head, and the other switch intended to turn on and off the sideways movement thereof. The invention should be understood to allow incorporation of all variations of controllers known from prior art, such as switches, buttons, knobs, triggers and touch-screen control.

In this embodiment, the nail filing head (115) of the nail filing machine (110) comprises a cylindrically shaped wheel (116) capable of rotating around its own axis. The wheel (116) is mounted horizontally and is configured to have its frontal side facing a nail placed on the finger placement unit (130). The wheel (116) on the nail filing head (115) has an abrasive surface such as sandpaper or glass-paper, such that rotation of the wheel (116) around its own axis causing filing of a nail's edge when pushed against a nail, while the sideways movement of the arm (114) allows a circumferential filing of the nail of a finger placed on the finger placement unit (130).

The cyclic movement of the nail filing head in this embodiment is formed by the rotation of the wheel (116) around its own axis, while the sideways movement is formed by an arm (114) on the nail filing machine (110) capable of rotating sideways, upon which the wheel (116) is mounted. Said arm is configured to turn the direction of the wheel centrally towards the nail when the arm is rotating sideways, such that the frontal side of the wheel (116) is facing the nail of a finger resting on the finger placement unit (130) at all positions throughout the movement range of the arm (114) to enable the wheel (116) to access all circumference of a nail of a finger placed on the finger placement unit (130). A mold (140) is installed on the distal end of the finger placement unit (130). The mold (140) is designed in the shape of the desired nail outline and having a narrow aperture with width and height suitable for a fingernail to cross through the mold (140), such that the reach of the nail filing head is restricted only to part of the nail crossing through the mold (140) to the internal space of the nail grooming device (100). The internal part of the wheel (116) is formed from a magnetic material, while the mold (140) is formed from a ferromagnetic material, thereby causing the nail filing head (115) to be attracted to the mold (140), such that the nail filing head (115) is getting gradually closer to the mold (140) during the filing of a nail until the wheel (116) is engaging contact with the mold (140) when the outline of the nail is aligned with the shape of the mold (140). Alternatively, the mold (140) may be formed from a magnetic part and the internal part of the wheel (116) may be formed from a ferromagnetic part. Various embodiments of this feature allow for any other configuration of magnetic attraction between two parts in the nail grooming device (100) that would result in attraction of the nail filing head (115) towards the nail of a finger placed on the finger placement unit (130).

Figure 2:
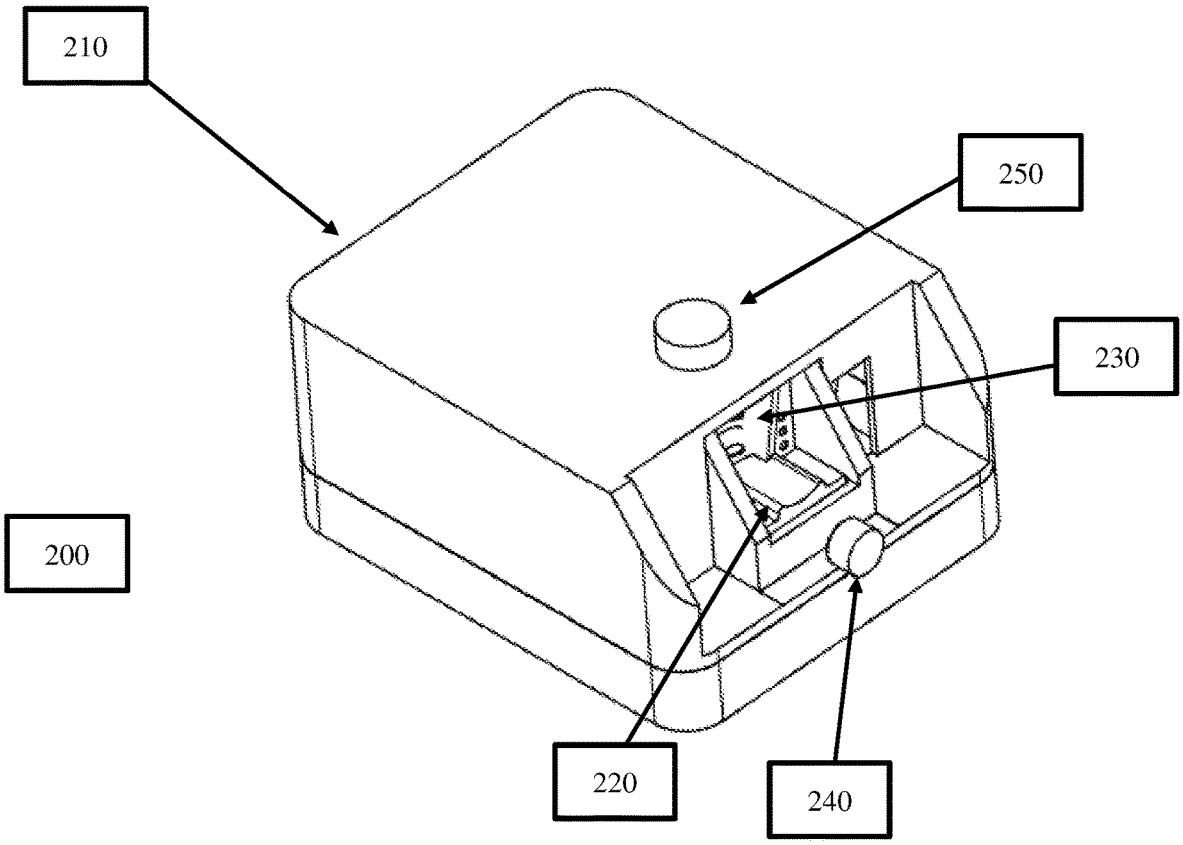
FIG. 2 depicts an external view of another embodiment of a nail-grooming device.

FIG. 2 depicts another embodiment of the present invention, wherein a nail-grooming device (200) has a casing (210) covering the nail filing machine and mechanism operating the cyclic movement and sideways movement, to protect said nail filing machine and mechanism and to provide a comfortable and aesthetic design of the device, whereas the finger placement unit (220) is not covered by the casing (210) to allow comfortable access for a user to place finger.

The nail grooming device (200) comprises a mold (230) that restricts the reach of the nail filing head, having the shape of the desired nail outline and having a narrow aperture with width and height suitable for a fingernail to cross through the mold (230). The mold is mounted on the distal end of the finger placement unit (220), allowing the nail of a finger placed on the finger placement unit (220) to be inserted through the narrow aperture, and into a position wherein the nail is situated in proximity with the nail filing head.

This embodiment further comprising a nail size adjustment knob (240), allowing the user to set the position of the mold (230) vis-à-vis a finger placed on the finger placement unit (220), and a finger selector knob (250), allowing the user to switch between different apertures on the mold (230) in different sizes, each suitable for a different finger.

Figure 3A:
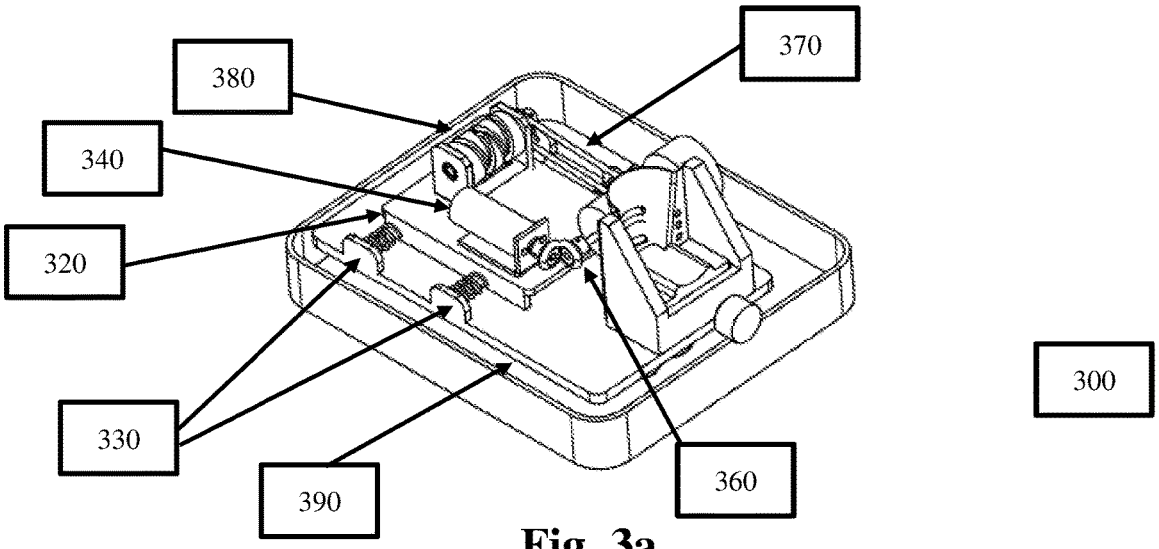
FIG. 3*a*, FIG. 3*b* and FIG. 3*c* depict internal views of the nail-grooming device shown in FIG. 2.
Figure 3B:
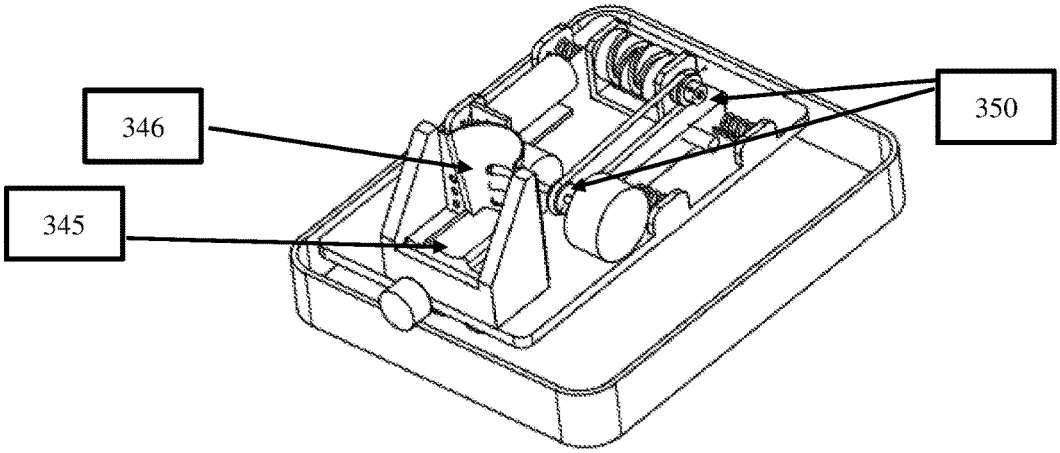
Figure 3C:
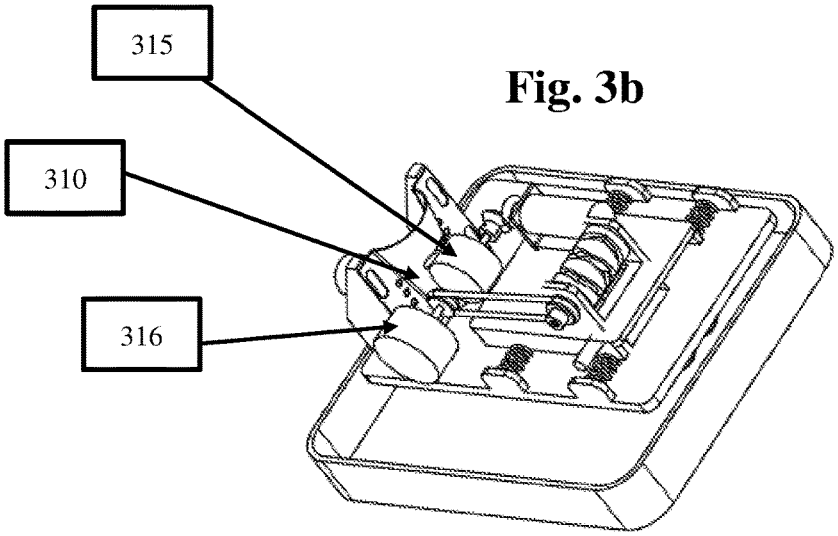

FIG. 3*a*, FIG. 3*b* and FIG. 3*c* depict the nail-grooming device shown in FIG. 2 without a casing covering the said filing head and mechanism. These illustrations display another embodiment of a nail grooming device (300) with another mechanism operating the cyclic movement and sideways movement.

In this embodiment, the nail filing head (310) comprising a wheel (315) capable of rotating around its axis. The wheel (315) is mounted on a floating chassis (320) capable of sideways movement on a curved horizontal axis. The floating chassis (320) is installed on two helix shaped screws (330) transversely fixed on base of nail filing machine (390). An electromechanical motor (340) drives the rotation of the wheel around its axis, while a pulley (350) is installed beside the wheel (350) on the wheel shaft (360), using the torque of the shaft to pull a belt (370), which in turn spins another pulley (350) causing a shaft with cylinder having grooves in the form of a leadscrew of both handednesses (allowing for infinite rotation) (380) to rotate. The grooves of the cylinder (380) are installed on the rear part of the base of nail filing machine (390), thus the rotation of the cylinder (380) propels the sideways movement of the floating chassis (340) on the rear helix shaped screw (330). The sideways movement of the rear part of the floating chassis (320) occurs while the wheel (315) is pressed against the nail of a finger placed in the finger placement unit (345), thus forming a curved sideways movement axis of the wheel (315) allowing the filing of a nail around its circumference according to the shape of the mold (346).

This embodiment further comprises a cleaning brush (316) on the nail filing head (310) that can be used after filing of a nail to clean the nail from nail debris left on the nail. The cleaning brush (316) is an additional wheel covered by a soft surface that allows cleaning of a nail. The cleaning brush (316) is installed on the same wheel shaft (360) upon which the wheel (315) is installed and using the torque of the wheel shaft (360), being accessible to a nail through another aperture on the casing of the device.

Figure 4:
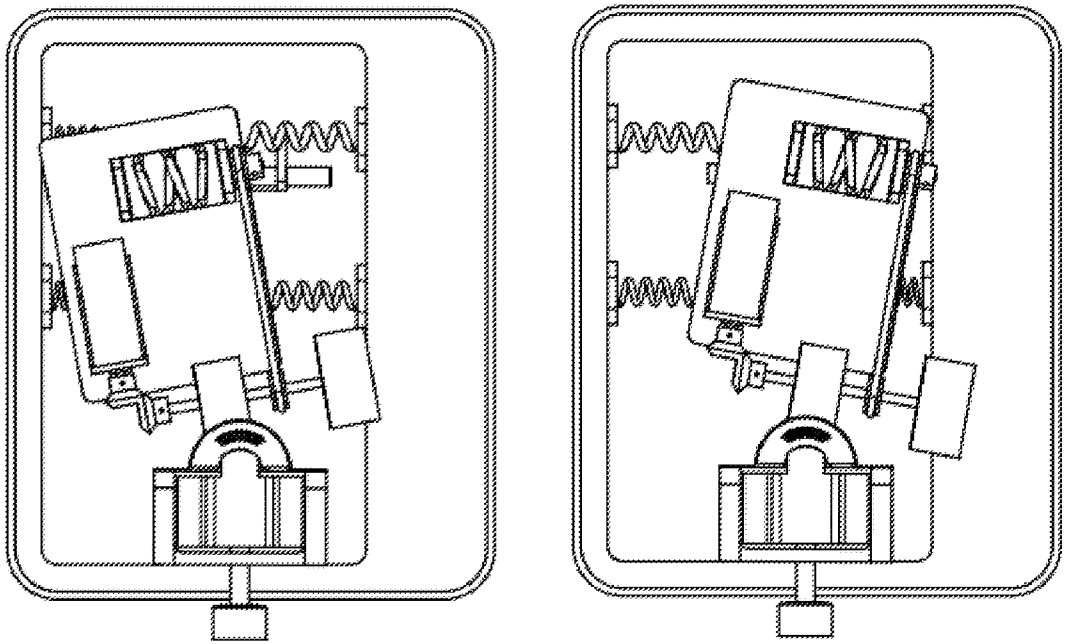
FIG. 4 depicts a top internal view of the nail-grooming device shown in FIG. 2.

FIG. 4 depict the nail-grooming device shown in FIG. 2, FIG. 3*a*, FIG. 3*b* and FIG. 3*c* without a casing covering the said filing head and mechanism, from a top view. This illustration demonstrates the curved axis sideways movement of the floating chassis on the helix shaped screws.

Figure 5:
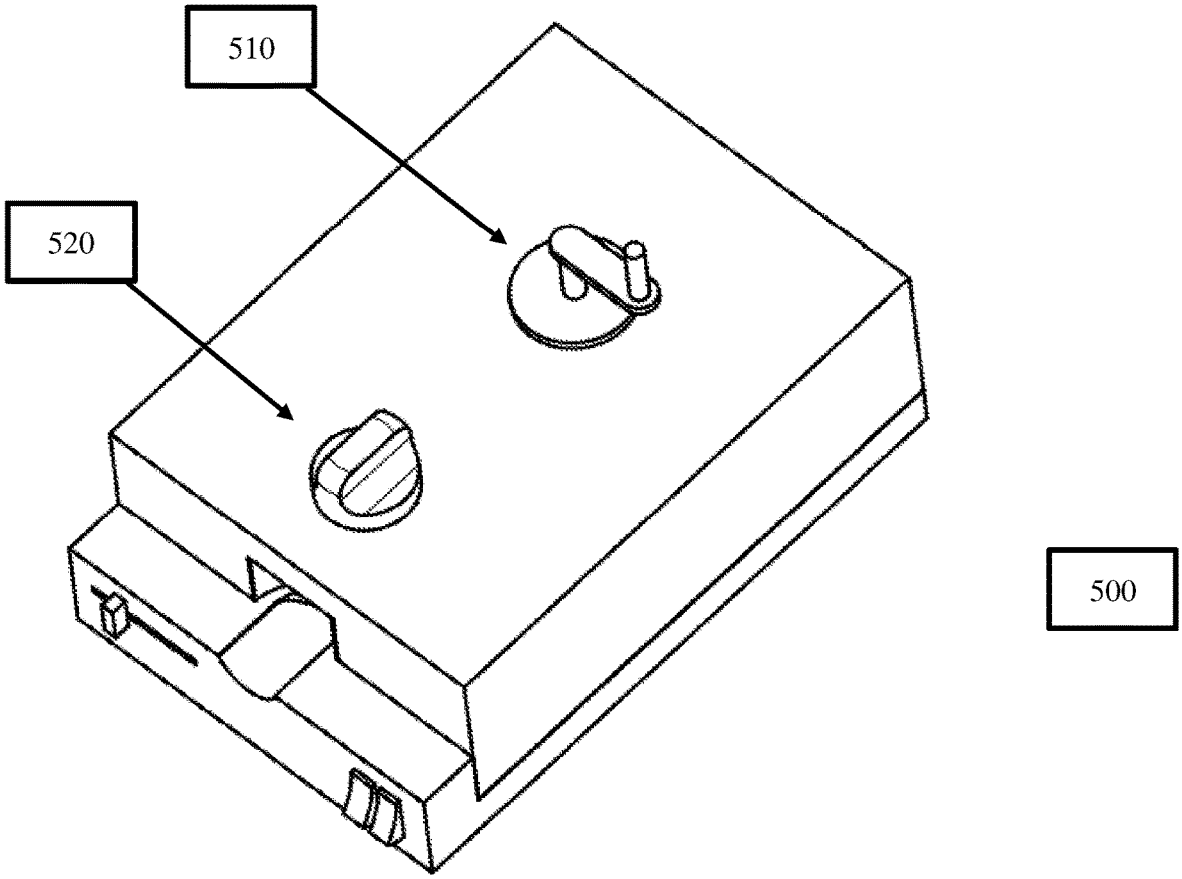
FIG. 5 depicts a manually operated nail-grooming device.

FIG. 5 depicts another embodiment of the present invention, wherein the cyclic movement and the sideways movement of the filing head are propelled manually without utilizing a power source. In this embodiment, the nail grooming device (500) comprises a revolving handle (510) which is used to drive the cyclic and sideways movement of the nail filing machine. This embodiment further comprises a knob (520) for adjustment of the position of the mold. The invention should be understood to allow incorporation of all variations of manual controllers known from prior art, such as revolving handles, buttons, knobs and triggers. Furthermore, the invention should be understood to allow combination of different mechanisms, manual, electromechanical or others, each for a different function of the device.

Figure 6A:
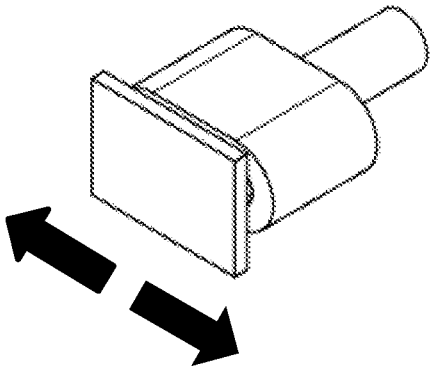
FIG. 6*a*, FIG. 6*b*, FIG. 6*c* and FIG. 6*d* depict different types of filing heads.
Figure 6B:
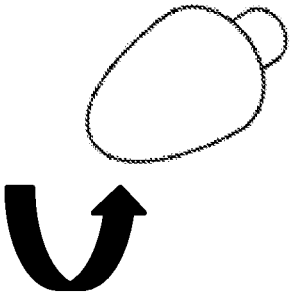
Figure 6C:
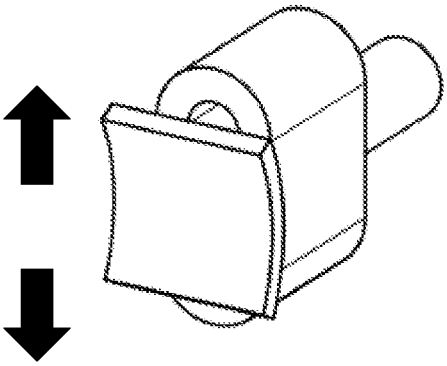
Figure 6D:
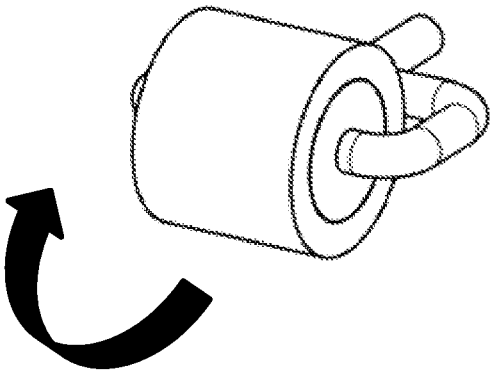

FIG. 6*a*, FIG. 6*b*, FIG. 6*c* and FIG. 6*d* depict different types of filing heads, each with a different pattern of cyclic movement. FIG. 6*a* is a flat nail file configured to have a sideways cyclic movement. FIG. 6*b* is a cylindrical nail file with its rotation axis facing the nail of a finger placed on the finger placement unit, configured to have a drill-like rotational cyclic movement. FIG. 6*c* is a flat nail file configured to have an up-and-down cyclic movement. FIG. 6*d* is a wheel shaped nail file with its front side facing the nail of a finger placed on the finger placement unit, configured to have an infinite upward or downward cyclic movement.

Figure 7A:
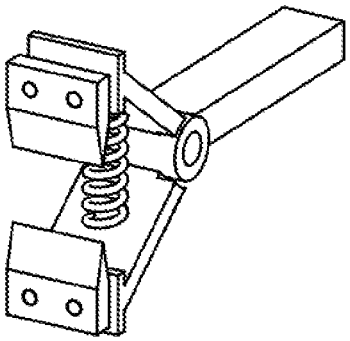
FIG. 7*a* and FIG. 7*b* depict different types of nail-grooming heads.
Figure 7B:
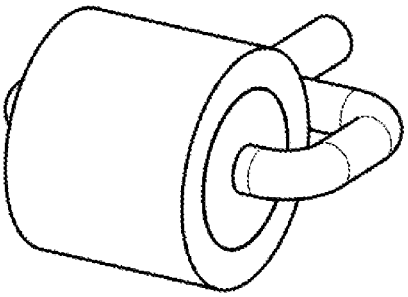

FIG. 7*a* and FIG. 7*b* depict different types of nail-grooming heads. FIG. 7*a* depicts an embodiment of the invention, wherein the nail-grooming head is a nail clipper. FIG. 7*b* depicts an embodiment of the invention, wherein the nail-grooming head is a nail cleaner.

Figure 8:
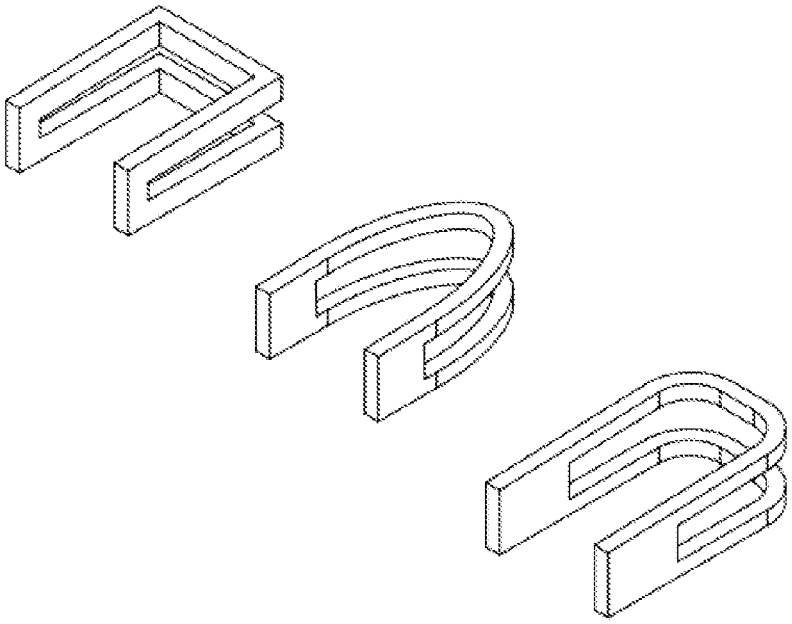
FIG. 8 depict different molds corresponding to different nail shapes.

FIG. 8 depict different molds to be installed on the device. Each mold restricts the reach of the nail filing head, such that only the part of nail crossing the mold is accessible to the nail filing head, causing the nail to be filed in accordance with the shape of the mold. In some embodiments, the device further comprises of a set of different molds corresponding to different nail shapes, allowing the user to switch between different molds. The present invention should be understood to allow any means to set a movement pattern known from prior art, such as elevated surfaces, molds, frames, grooves, cams, circumferential tracks, and the like.

Figure 9A:
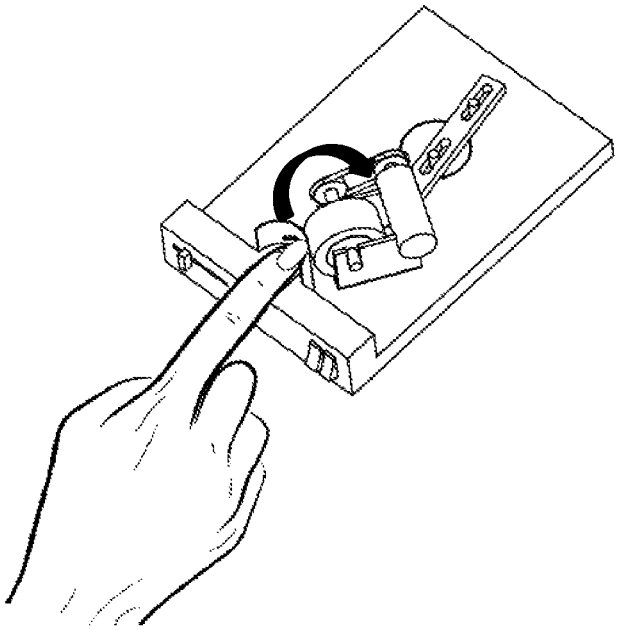
FIG. 9*a* and FIG. 9*b* illustrate a method for filing a nail.
Figure 9B:
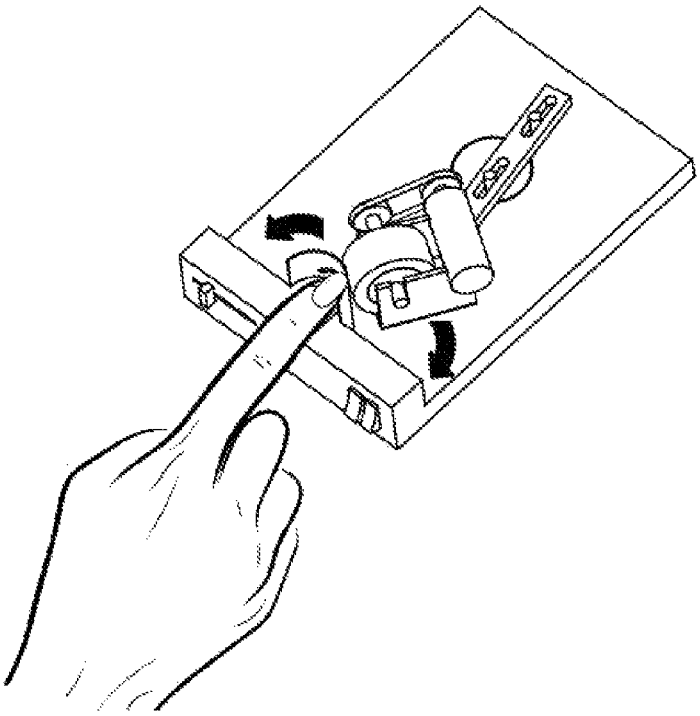
Figure 10:
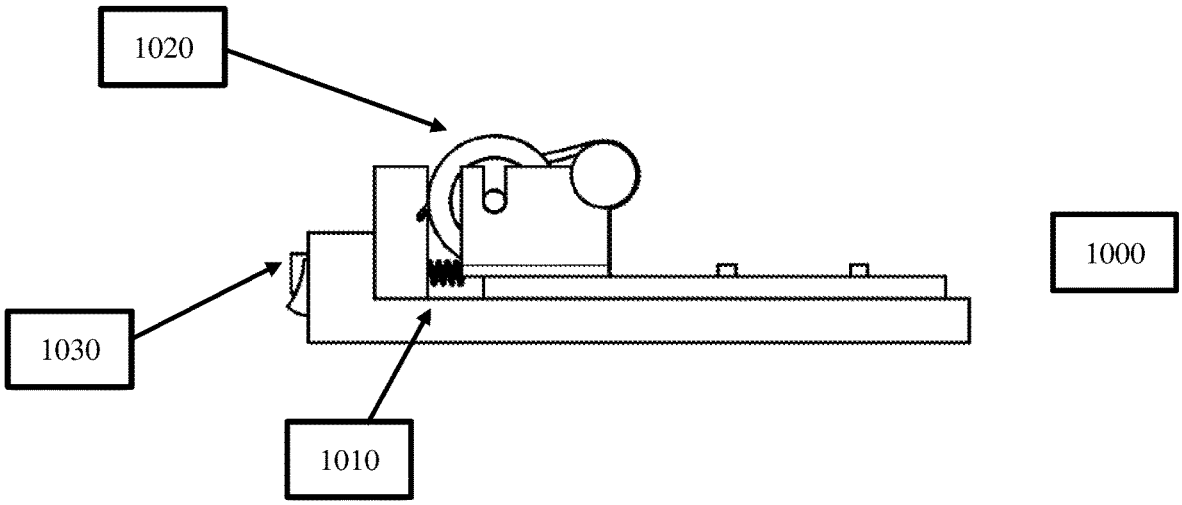
FIG. 10 depicts internal view of a nail grooming device comprising a spring configured to pull nail filing head towards nail of a finger placed on the finger placement unit.

FIG. 9*a* and FIG. 9*b* illustrate a method for utilizing the nail-grooming device for filing a nail using the steps:

a. Positioning a finger on the finger placement unit, such that the nail rests on the elevated surface on the inner side of the finger placement unit and operating the device to activate cyclic movement of the nail file (FIG. 9*a*);

b. Operating the device to engage sideways movement of the nail file, while cyclic movement is activated, such that the device is performing at least one full sideways movement cycle for filing of the circumference of the nail (FIG. 9*b*);

FIG. 10 depicts internal view of a nail grooming device (1000) comprising a spring (1010) configured to push nail filing head (1020) towards nail of a finger placed on the finger placement unit (1030).

Figure 11:
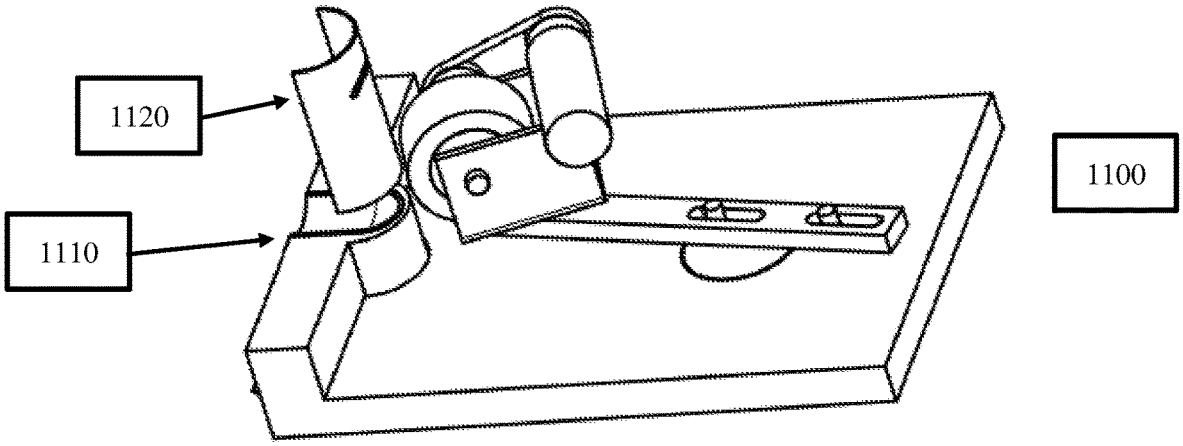
FIG. 11 depicts an adapter for nail filing mold on nail grooming device and an adaptable nail filing mold.

FIG. 11 depicts an adapter (1110) in the form of an elongated slot for mounting a nail filing mold on nail grooming device (1100), and an adaptable nail filing mold (1120) configured to fit into said adapter (1110).

Figure 12:
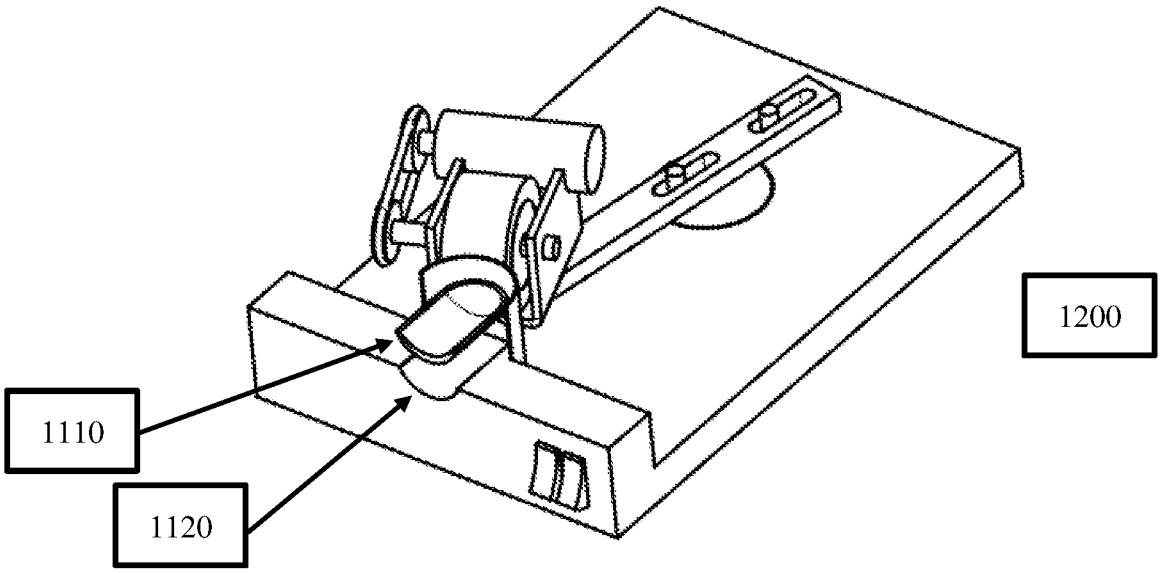
FIG. 12 depicts a detachable finger placement unit.

FIG. 12 depicts a nail grooming device (1200) with a detachable finger placement unit (1210). The nail grooming device having a concave part (1220) upon which the detachable finger placement unit (1210) is installed, and suitable for accommodating replaceable finger placement units.

Figure 13:
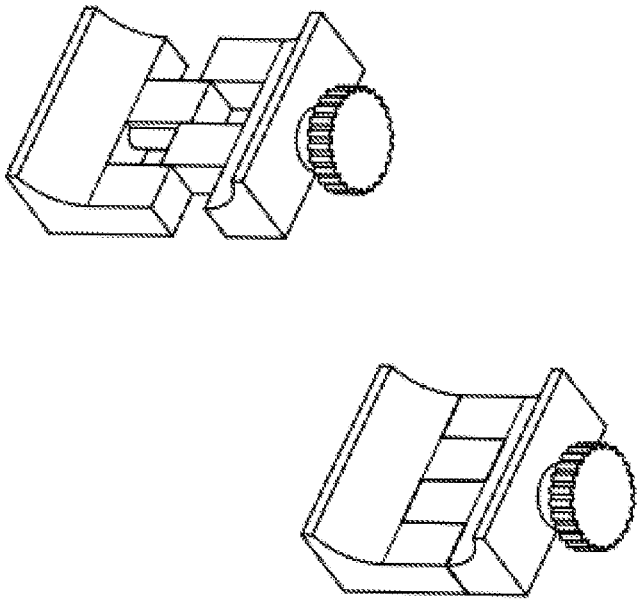
FIG. 13 depicts a finger placement unit with a width adjustment mechanism.

FIG. 13 depicts a finger placement unit with a width adjustment mechanism in its narrowest setting and widest setting. This embodiment should be interpreted to allow any kind of mechanism known from the prior art suitable for width adjustment.

Figure 14:
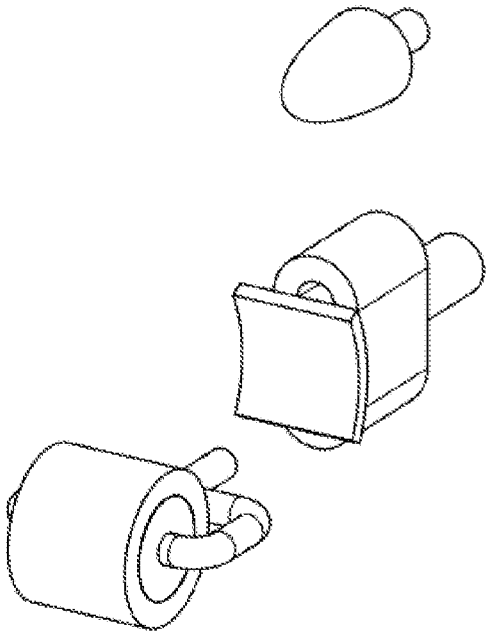
FIG. 14 depicts a set of adaptable nail filing heads.

FIG. 14 depicts a set of adaptable nail filing heads. The set in the illustration contains a horizontally mounted filing wheel, a vertically positioned filing surface, and a drill-like filing wheel with its axis point facing the finger placement unit. This embodiment should be interpreted to incorporate all known forms of nail filing heads varying in shapes, sizes, textures, angles and surface profiles, to fit to specific purposes.

Figure 15:
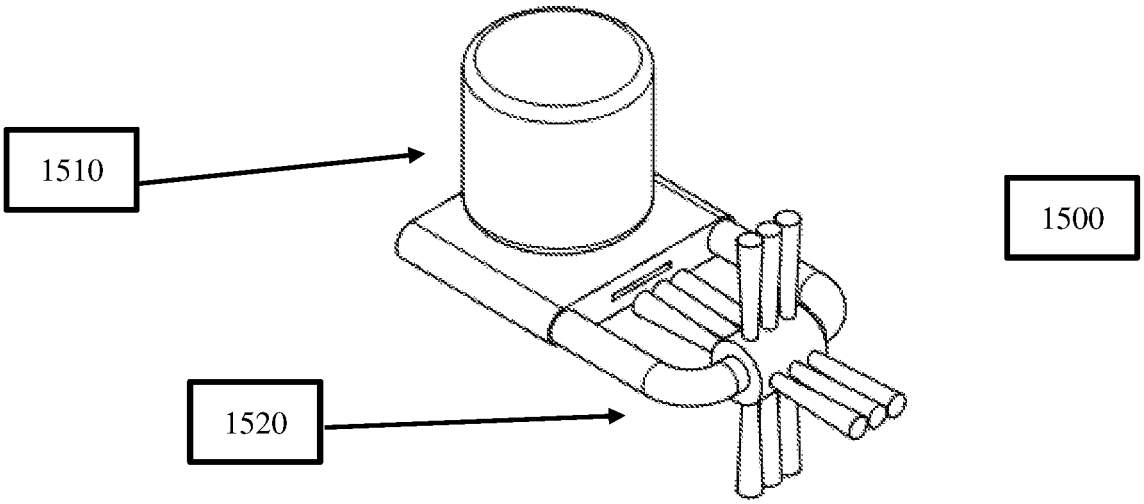
FIG. 15 depicts a nail polish head.

FIG. 15 depicts a nail polish head (1500) adaptable to an adapter on arm of nail filing machine, said nail polish head (1500) comprising a nail polish brush (1520) for applying nail polish on a nail of a finger placed on finger placement unit and a container (1510) fillable with liquid nail polish. The container (1510) is in flow communication with the nail polish brush (1520), thereby feeding nail polish into the nail polish brush (1520).

The described method should be applied mutatis mutandis on each of the different nail-grooming applications mentioned in this description.

The foregoing description and illustrations of the embodiments of the invention have been presented for the purposes of illustration. It is not intended to be exhaustive or to limit the invention to the above description in any form.

Any term that has been defined above and used in the claims, should be interpreted per this definition.

Figure 16A:
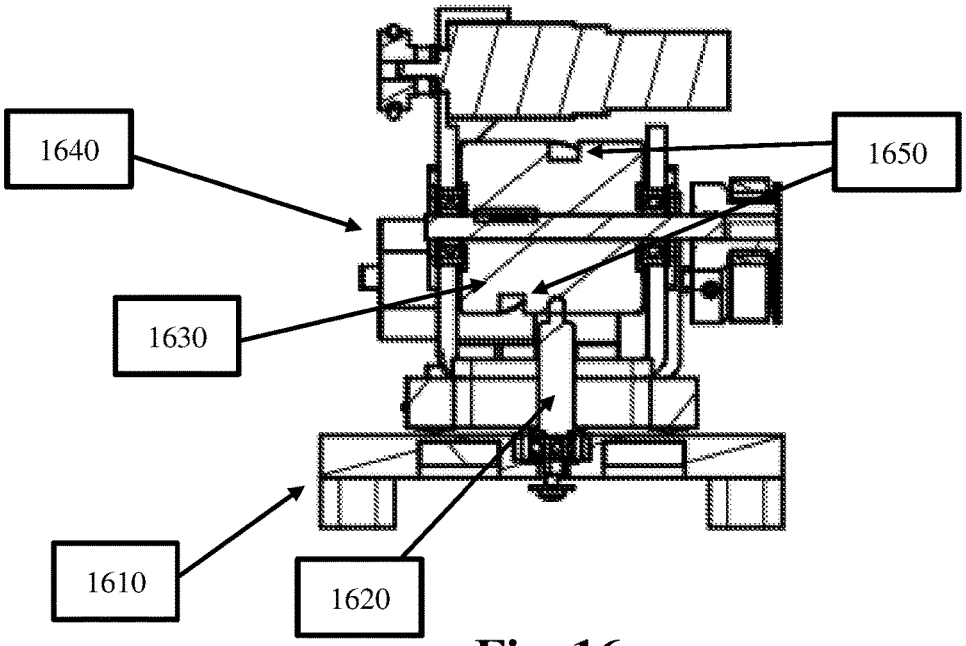
FIG. 16*a*, FIG. 16*b* and FIG. 16*c* depict another embodiment of nail grooming device and mechanism of sideways movement of the nail filing machine.
Figure 16B:
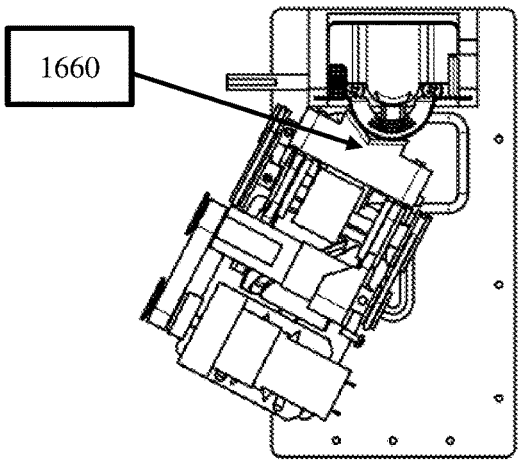
Figure 16C:
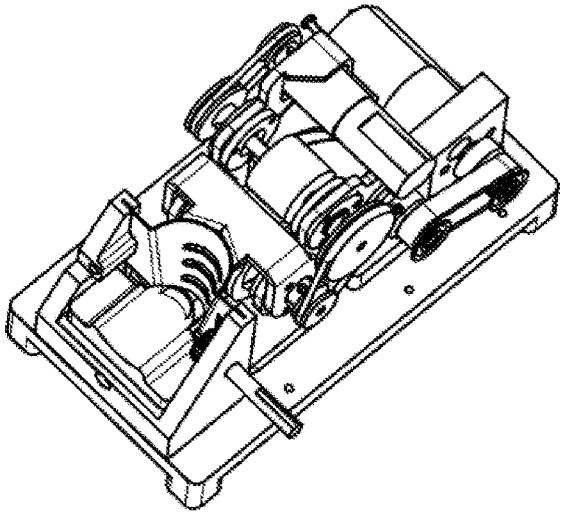

FIG. 16*a*, FIG. 16*b* and FIG. 16*c* depict a nail grooming device and mechanism of sideways movement of the nail filing machine. FIG. 16*a* depicts a rear view of a nail grooming device. FIG. 16*b* depicts the nail grooming device from a top view, with the nail filing machine pulled to the left side of nail grooming device during its operation. FIG. 16*c* depict the nail grooming device from a top perspective view. A shaft (1620) is vertically fixed on base part of the nail grooming device (1610). The nail filing machine (1640) having a cylindrical wheel (1630) rotatably installed in horizontal position within nail filing machine (1640). The cylindrical wheel (1630) is driven by a motor to generate continuous rotation, said motor also generates rotation of the filing wheel on nail filing head. The cylindrical wheel (1630) has a single groove (1650) surrounding its circumference and twisting transversely across the width of the surface of the cylindrical wheel (1630). The top end of the shaft (1620) is positioned inside the groove (1650), whereas the rotation of the cylindrical wheel (1630) causing the cylindrical wheel to continuously change its position transversely vis-à-vis the shaft (1620), thereby forcing the entire nail filing machine (1640) which the cylindrical wheel (1630) forms a part thereof to sway sideways on a curved axis resulting in a sideways movement of the nail filing head (1660).

The invention claimed is:

1. A nail grooming device comprising:

a finger placement unit suitable for accommodating a user's finger in a fixed position;

a nail filing machine with a nail filing head wherein said nail filing head comprises a cylindrically shaped wheel covered with an abrasive or rugged surface suitable for filing a nail;

a control unit operable to propel cyclic and sideways movement of said nail filing head; and a mold installed on a distal end of said finger placement unit, said mold designed in the shape of a desired nail outline with a narrow aperture for a fingernail to cross through, restricting the reach of the nail filing head only to the part of the nail crossing through the mold;

wherein said nail filing machine is capable of propelling cyclic movement of said nail filing head for filing a nail while a finger is placed on said finger placement unit, and is further capable of propelling sideways movement of said nail filing head on a curved horizontal axis to allow circumferential movement around the desired outline of the nail while a finger is placed on said finger placement unit;

wherein said nail grooming device is operable through said control unit to circumferentially file nail of a finger placed on said finger placement unit without changing the position of said nail grooming device or finger; and wherein said mold and wheel are configured to establish magnetic attraction such that the nail filing head is magnetically drawn gradually closer to the mold during the filing process, ultimately achieving contact with the mold when the nail reaches alignment with the desired nail shape as dictated by the mold.

2. The device of claim 1, wherein said nail grooming device comprises an adapter suitable for fixing a mold around finger placement unit.

3. The device of claim 1, wherein said nail grooming device comprises a set of adaptable molds in different shapes and sizes, such that each of said set of adaptable molds is capable of being fixed to said adapter to restrict movement of said nail file around a nail of a finger placed on said finger placement unit.

4. The device of claim 1, wherein said nail filing head and said mold comprises, respectively and interchangeably, a magnetic part and ferromagnetic part, such that said nail filing head is gradually attracted towards said mold.

5. The device of claim 1, wherein said nail filing head and each of said set of adaptable molds comprising, respectively and interchangeably, a magnetic part and ferromagnetic part, such that said nail filing head is gradually attracted towards each of said set of adaptable molds.

6. The device of claim 1, wherein said nail filing machine comprises a spring configured to push said nail filing machine towards said finger placement unit.

7. The device of claim 1, wherein said nail grooming device is operated by an electromechanical motor.

8. The device of claim 1, wherein said nail grooming device is operated manually by a mechanical mechanism.

9. The device of claim 1, wherein said finger placement unit is detachable from said nail grooming device and replaceable.

10. The device of claim 1, wherein said nail grooming device comprises a mechanism for adjustment of width of said finger placement unit.

11. The device of claim 1, wherein said nail filing machine comprises an adapter for mounting a removable nail filing head.

12. The device of claim 1, wherein said nail grooming device comprises a set of removable nail filing heads adaptable to said adapter on said nail filing machine.

13. The device of claim 1, wherein said nail filing machine is capable of performing a variety of patterns of said cyclic movement.

14. The device of claim 1, wherein said nail filing machine is capable of performing a variety of patterns of said sideways movement.

15. The device of claim 1, wherein the speed of said cyclic movement is adjustable through said control unit.

16. The device of claim 1, wherein the speed of said sideways movement is adjustable through said control unit.

17. The device of claim 1, wherein said nail grooming device comprises nail polish head installable on said nail filing machine, and wherein said nail polish head comprises a nail polish brush and a container fillable with liquid nail polish.

18. The device of claim 1, wherein said nail grooming device comprises a nail trimming head installable on said nail filing machine.

19. The device of claim 1, wherein said nail grooming device comprises a nail filing wheel head installable on said nail filing machine.

20. The device of claim 1, wherein said nail grooming device comprises a nail cleaning head installable on said nail filing machine.

21. The device of claim 1, wherein said nail grooming device comprises multiple sets of said nail filing machine and said finger placement unit for simultaneous filing of multiple nails.

22. The device of claim 1, wherein said nail grooming device is designed to accommodate toes on a foot and to file nails of toes on a foot.

23. The device of claim 1, wherein said nail grooming device is controllable via a computer application.

* * * * *